United States Patent [19]

Walker

[11] 4,248,022

[45] Feb. 3, 1981

[54] EXTERIOR WINDOW SHUTTER ASSEMBLY

[75] Inventor: C. Murchison Walker, Hollywood, Fla.

[73] Assignee: Weather Control Shutters, Inc., Hollywood, Fla.

[21] Appl. No.: 86,698

[22] Filed: Oct. 22, 1979

Related U.S. Application Data

[63] Continuation of Ser. No. 659,248, Feb. 2, 1976, abandoned.

[51] Int. Cl.[3] ..... E06B 7/08; E04C 2/38

[52] U.S. Cl. ..... 52/473; 52/400; 52/672; 52/815; 52/816; 98/99.8; 98/114; 160/397

[58] Field of Search ..... 49/440; 160/394, 397; 98/114, 99.6, 99.8; 52/473, 475, 455, 456, 814, 815, 397, 400, 672, 671, 670, 816

[56] References Cited

U.S. PATENT DOCUMENTS

| | | | |
|---|---|---|---|
| 749,116 | 1/1904 | Valentine | 52/626 |
| 2,053,254 | 9/1936 | Fairchild et al. | 52/626 |
| 2,111,448 | 3/1938 | Hoffman | 52/626 |
| 2,666,508 | 1/1954 | Nardulli | 403/295 |
| 2,667,951 | 2/1954 | Gall | 52/399 |
| 2,784,782 | 3/1957 | Young | 98/114 X |
| 2,816,632 | 12/1957 | Nardulli | 52/627 |
| 2,841,835 | 7/1958 | Nardulli | 49/504 |
| 3,216,538 | 11/1965 | Miller | 52/282 X |
| 3,344,573 | 10/1967 | Martin et al. | 52/400 X |
| 3,349,533 | 10/1967 | Gregoire | 52/397 |
| 3,452,477 | 7/1969 | Sassano | 49/116 |
| 3,452,501 | 7/1969 | Zimmer et al. | 52/282 X |
| 3,727,664 | 4/1973 | Mennuto | 52/456 X |
| 3,889,434 | 6/1975 | Shelver | 52/475 X |

FOREIGN PATENT DOCUMENTS

| | | | |
|---|---|---|---|
| 852513 | 9/1970 | Canada | 160/394 |
| 458753 | 4/1928 | Fed. Rep. of Germany | 52/670 |
| 2005498 | 9/1970 | Fed. Rep. of Germany | 52/456 |
| 268744 | 10/1929 | Italy | 52/473 |
| 606038 | 8/1960 | Italy | 49/440 |

*Primary Examiner*—Leslie Braun
*Attorney, Agent, or Firm*—John C. Thompson

[57] ABSTRACT

A shutter assembly for use on an exterior wall surface at a window opening or the like, the shutter assembly consisting of a frame and a panel formed of an expanded metal sheet, the expanded metal sheet being provided with a plurality of air vent defining means. The side or jamb members of the frame and the upper and lower frame members are each provided with improved means to hold an expanded metal sheet of novel design within the frame so that it can withstand high loading imposed upon it as for example during a hurricane. In addition, an improved method of assembling the shutter is disclosed herein.

5 Claims, 14 Drawing Figures

EXTERIOR WINDOW SHUTTER ASSEMBLY

This is a Continuation of application Ser. No. 659,248, filed Feb. 2, 1976 now abandoned.

FIELD OF THE INVENTION

The present invention relates generally to shutters or the like and more specifically to that class of shutters which are generally called hurricane shutters. In accordance with the principles of the present invention an improved frame construction more securely holds an interior panel formed of an expanded metal sheet of a novel construction. In addition, a novel method of assembling the shutter is disclosed herein.

BACKGROUND OF THE PRESENT INVENTION

A prior art hurricane shutter is shown in U.S. Pat. No. 3,452,477 issued July 1, 1967 to John H. Sassano. Each shutter includes spaced apart side or jamb members and upper and lower frame members, the various frame members being secured to each other to form a generally rectangular rigid frame. A panel formed of an air permeable metal structure is mounted within the frame, the metal structure being provided with air vent defining means. The upper and lower edges of the metal structure are received within a slot in the upper and lower frame members, and it is secured in place by means of a screw or the like. In a related construction the side edge portions of the expanded metal are formed into a U-shape with the bight of the U being parallel to the principal surface of the panel. The U-shaped edge is secured within the jamb by various parts which restrict the movement of the U-shaped edge out of the jamb, the various parts and the U-shaped edge being secured by pop rivets or the like.

While the prior art construction shown in the aforesaid patent and also described above have been generally satisfactory it should be observed that it is generally necessary to provide separate fastener means to rigidly hold the edge portions of the panel to the side, upper and lower frame members. This distracts from the appearance of the final shutter assembly and also requires additional time and labor in assembling the shutter in view of the necessity of adding various fasteners along the edges. Also, as the panel is customarily formed of aluminum it can tear where the fasteners engage the edges thus permitting the panel to be kicked out or blown out if an air borne projectile should hit it during a hurricane or the like.

OBJECTS AND SUMMARY OF THE INVENTION

It is a principal object of the present invention to provide a hurricane shutter assembly wherein the edges of a panel formed of an expanded metal sheet can be securely mounted to the side, upper and lower frame members of a frame without the requirements of separate fasteners which pass through the various frame members, the shutter assembly meeting and substantially exceeding wind loading requirements established by various building codes.

More specifically, it is an object of the present invention to provide a shutter assembly having improved upper and lower frame members provided with resilient means or teeth which firmly engage air vent defining means along the upper and lower edges of an expanded metal sheet of an improved design to firmly hold these edge portions within the upper and lower frame members.

It is an additional object of the present invention to provide a shutter assembly having an improved jamb construction which securely holds bent side edge portions of an expanded metal panel to prevent its withdrawal under extreme force loadings.

It is a further object of the present invention to provide a novel method of assembling the shutter of this invention.

These and other objects and advantages of the present invention will be apparent to those skilled in the art after a consideration of the following detailed description taken in conjunction with the accompanying drawings in which preferred forms of this invention are illustrated. In summary, the invention relates to a shutter assembly provided with a panel formed of expanded metal of a novel construction having a plurality of outwardly extending air vent defining means on its surface, the side edge portions of the expanded metal sheet means being disposed at an acute angle to the surface of the principal portion of the expanded metal sheet. These side edge portions are telescopically received within jamb members provided with a recess and an opening in an inner sidewall in communication with said recess, the width of said opening being considerably less than the distance between the outermost edge of the side edge portions and the adjacent surface of the principal portion. The upper and lower frame members are each provided with resilient teeth extending from one slot defining sidewall towards another slot defining sidewall, the upper and lower members being force fit into their final assembled position along the upper and lower edges of the expanded metal sheet in such a manner that the resilient teeth engage the air vent defining means along the upper and lower edges of the expanded metal sheet to firmly hold the expanded metal within the frame. The jamb members are secured to the upper and lower frame members after the expanded metal sheet has been assembled within the frame by conventional fastener means.

BRIEF DESCRIPTION OF THE DRAWINGS

FIG. 13 is a perspective view of a shutter assembly having upper and lower panels, the lower panel being an expanded metal sheet, and the upper panel being glass or the like.

DETAILED DESCRIPTION OF FIGS. 1 TO 10

Figure 1:
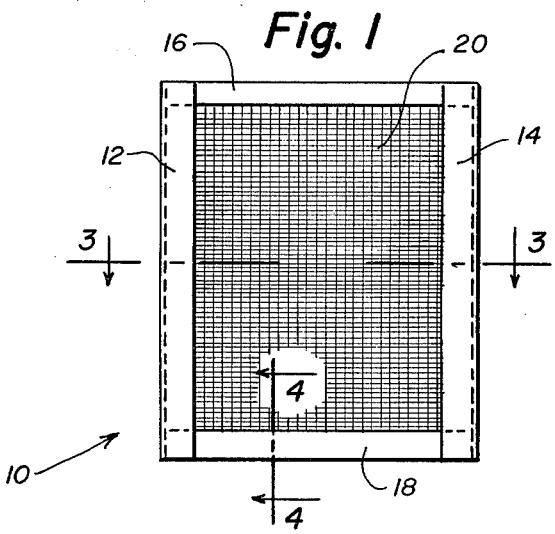
FIG. 1 is a side elevational view of a single width shutter assembly embodying the principles of this invention.
Figure 2:
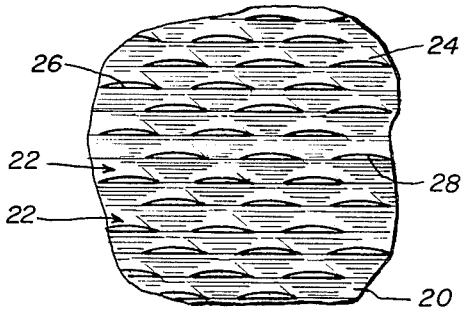
FIG. 2 is a partial perspective view of the expanded metal sheet means employed in the shutter assembly of this invention.

Referring first to FIG. 1 in which one embodiment of this invention is illustrated, the single width shutter assembly, which is indicated generally at 10, includes spaced apart opposed left and right jamb members 12 and 14, respectively, upper and lower frame members 16, 18, respectively, and a panel made of expanded metal sheet 20. The left and right jamb members 12 and 14 are substantially identical in cross-section. Similarly, the upper and lower frame members 16 and 18 are also substantially identical in cross-section. The expanded metal sheet includes a plurality of outwardly extending air vent defining means indicated generally at 22 in FIG. 2, each of the air vent defining means including a convex projection 24 which extends away from the original outer surface of the expanded metal sheet, the original outer surface being indicated by the dot dash line 25 in FIG. 10. Each projection is disposed above a transversely extending slit 26 which extends through the metal sheet, the lower edge 28 of the convex projection being in an arcuate shape when viewed from the lower edge of the expanded metal sheet as can best be seen from an inspection of FIG. 2. The convex projection above the slit tapers towards the original outer surface of the expanded metal sheet. The air vent defining means 22 extend from the upper edge 30 to the lower edge 32 of the expanded metal sheet, and may also extend entirely from the left side 34 to the right side 36. However, the outermost side edge portions of the expanded metal sheet may be free of the air vent defining means without detracting from the appearance of the assembled shutter or interfering with the manner which it is to be mounted within the jamb members.

Figure 4:
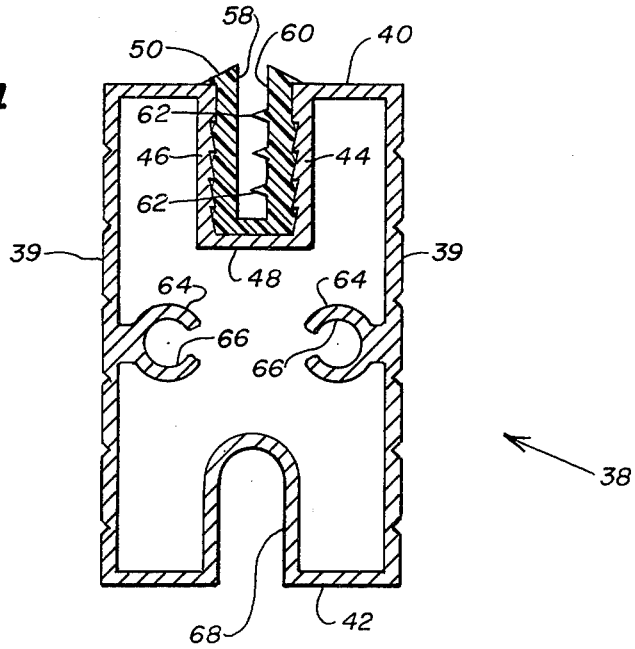
FIG. 4 is an enlarged section taken along the line 4—4 in FIG. 1 showing a cross-section of the lower frame member, the lower edge of the expanded metal sheet not being shown for purposes of clarity.
Figure 10:
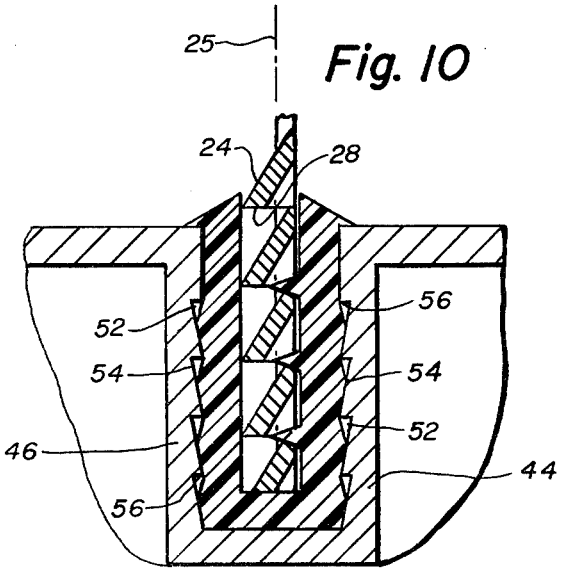
FIG. 10 is an enlarged cross-sectional detail view showing the manner in which the peripheral edge portion of the expanded metal sheet is engaged by the lower frame means.

The upper and lower frame members 16 and 18 may be called in the trade vent head and sill members, respectively when used in the manner shown in FIG. 1. These identical members, as can best be seen from FIG. 4, are extrusions of a generally rectangular cross-section, the extrusions being indicated generally at 38. Each extrusion has interior and exterior wall portions 39, an inner wall portion 40, and an outer wall portion 42. An inwardly facing channel is formed in the extrusion open to the interior wall portion 40, the channel being defined by opposed channel defining sidewalls 44, 46 and a bight portion 48. A resilient insert 50, which may be formed of a vinyl material, is mounted within the channel. The resilient insert is secured within the channel by transversely extending grooves 52 (FIG. 10). Each groove is defined by a first inclined surface 54 which facilitates the insertion of the insert 50 into the channel and a second surface 56 which is so angled with respect to said insert as to hinder its withdrawal from the channel. The resilient insert is provided with an inwardly facing slot defined by opposed sidewalls 58 and 60, the sidewall 58 in a preferred form being smooth and the other opposed sidewall 60 being provided with spaced apart teeth 62 which extend towards the sidewall 58, the teeth 62 and the sidewall 58 defining resilient engaging means. As can best be seen from FIG. 10 the teeth have a cross-sectional configuration in the form of an isoceles triangle. As can also be seen from FIG. 10 the opposed sidewalls 58, 60 of the insert are spaced away from each other a distance greater than the width of the expanded metal sheet, however, the distance from the crest of the resilient teeth 62 to the opposing sidewall 58 is less than the width of the expanded metal sheet. This construction permits the teeth 62 to firmly engage the convex projections 24 of the outwarly extending air vent defining means along the upper and lower edges 28, 30 of the expanded metal sheet to firmly hold the expanded metal sheet within the upper and lower frame members. While it has only been found necessary to provide one of the sidewalls 58, 60 with teeth 62 when engaging an expanded metal sheet of the type shown in the various Figures, it may be desirable with other forms of expanded metal material to provide teeth on both of the opposed sidewalls.

The extrusions forming the upper and lower frame members are each provided with bosses 64 extending to the interior of the frame member from the interior and exterior wall portions 39, each of the bosses being provided with a cylindrical recess 56 which is adapted to receive a self tapping screw or the like for the purposes which will be more fully brought out below. The outer wall 42 of the extrusion 38 is also provided with a groove 68 which facilitates the mounting of the shutter assembly in a mounting structure of the type disclosed in U.S. Pat. No. 3,452,477.

Figure 3:
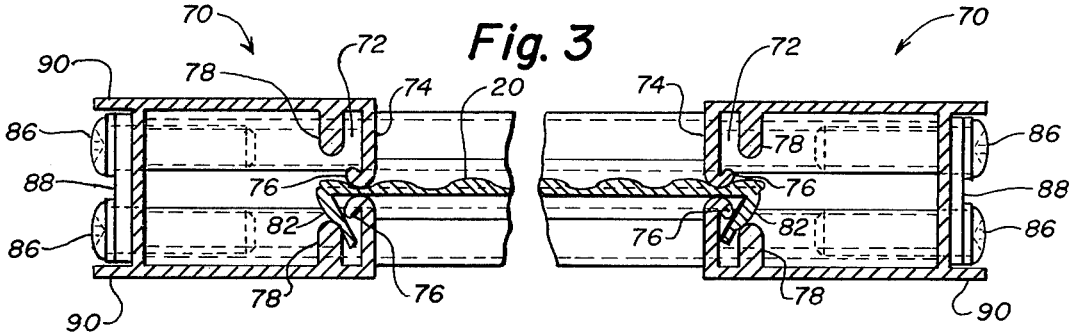
FIG. 3 is an enlarged section taken along the line 3—3 in FIG. 1 showing a cross-section of the jamb members and the expanded metal sheet, a portion of the expanded metal sheet being broken out.

Referring now to FIG. 3 in which the cross-sectional configuration of the jamb members is disclosed, it can be seen that each jamb member is an extrusion indicated generally at 70. (These extrusions and the extrusions 38 are preferably of aluminum material.) Each of the extrusions 70 has a generally rectangular cross-sectional configuration. A recess 72 is formed in the extrusions 70 and an opening is provided in the inner sidewall 74 in communication with the recess, the opening being defined by lip members 76. As can clearly be seen from the drawings, the width of the opening is substantially less than the width of the recess 72. Boss means 78 are also provided in the extrusion, the boss means extending into the recess and serving to maintain the side edge portions of the expanded metal sheet within the recess in a manner which will be more clearly brought out below.

Figure 5:
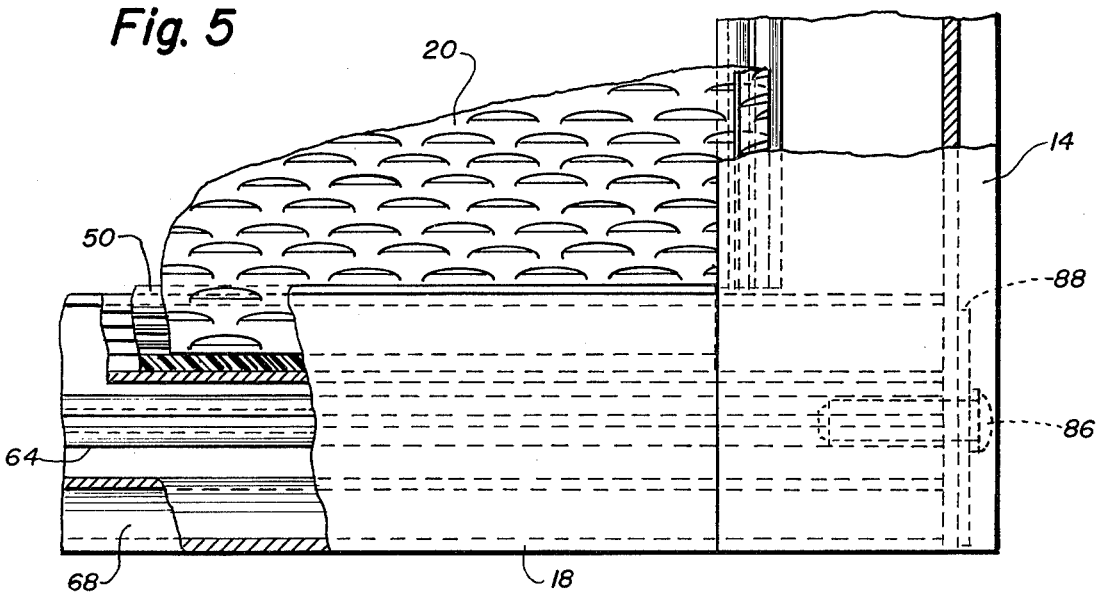
FIG. 5 is an enlarged side elevational view showing the manner in which the right jamb member is secured to the lower frame member.
Figure 6:
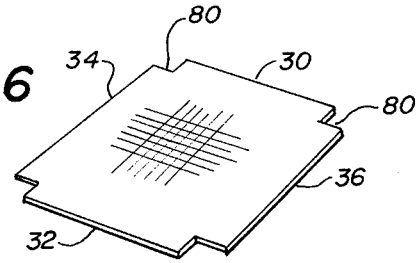
FIGS. 6 through 9 illustrate the manner in which the single width shutter of this invention is assembled, FIG. 6 illustrating the initial form of the expanded metal sheet, FIG. 7 illustrating the manner in which the initial form is bent, FIG. 8 illustrating the manner in which the side edge portions of the expanded metal sheet are telescoped within the jamb members, and FIG. 9 illustrating the manner in which the upper and lower frame members are assembled to the other components.
Figure 9:
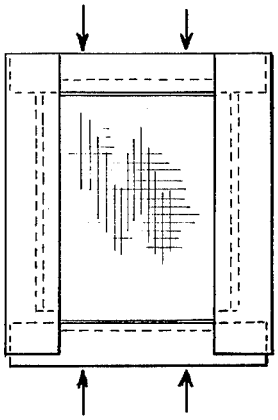

The shutter assembly illustrated in FIG. 1 is formed by providing a generally rectangular metal sheet of the configuration shown in FIG. 6, each of the corners being notched as at 80. Opposed side edge portions 82 (FIG. 7) are then bent until they are disposed at an acute angle of approximately 55 to 60 degrees to the surface of the principal portion 84. Jamb members 12 and 14 of the desired length are then provided and a portion of the boss 78 and also a portion of the inner wall portion 40 are removed from each end for a length equal to the width of each of the upper and lower frame members to facilitate the subsequent securement of the various frame members to each other. The portion of the boss 78 and inner wall 40 are preferably removed by punching them out with a horn die. The bent side edge portions are then telescopically inserted within the recess 72 of the jamb members 12 and 14 in the manner illustrated in FIG. 8. The upper and lower frame members consisting of the extrusion 38 and the resilient insert 50 are force fit over the edges 30, 32 in the manner illustrated in FIG. 9 until they are disposed in the position illustrated in FIGS. 1 and 5, the resilient teeth firmly engaging the air vent defining means to prevent their withdrawal under loadings well in excess of those required by various building codes. Fastener means in the form of self tapping screws 86 or the like then may be used to interconnect the jamb members and the upper and lower frame members to each other to form a generally rectangular rigid construction. The self tapping screws 86 are received within the cylindrical recesses 66 of the bosses 64 in the upper and lower frame members. The head of the screws will bear against a nylon washer 88 or the like. The heads of the screws and the nylon washer 88 are all disposed within an outer channel of the jamb members, the outer channel being defined by ears 90 as can best be seen from FIG. 3. Pop rivets (not shown) may also be used to secure the ends of the jamb members to the ends of the upper and lower frame members, the pop rivets passing through the wall portions 39.

The above construction has an improved appearance over other prior art constructions and will withstand greater loadings during a hurricane or the like. In the event that the side edge portions should start to bend open during extreme loading conditions it should be noted that they will engage the boss means 78 during bending and that the boss means 78 will restrict further bending and thereby maintain the side edge portions within the recesses 72.

DETAILED DESCRIPTION OF FIGS. 11 AND 12

Figure 11:
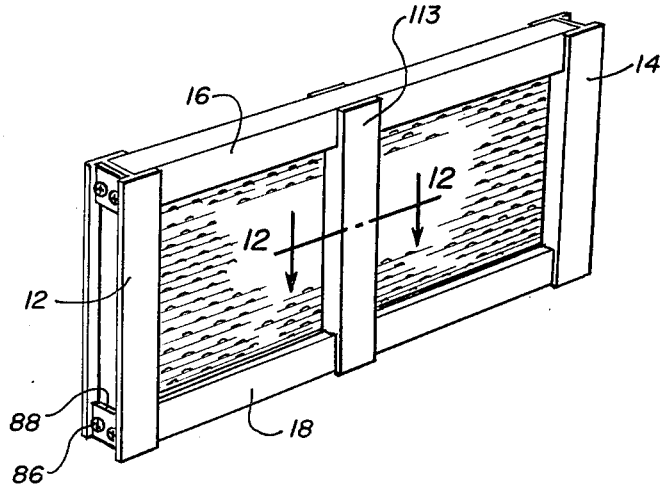
FIG. 11 is a perspective view of a double width shutter assembly.
Figure 12:
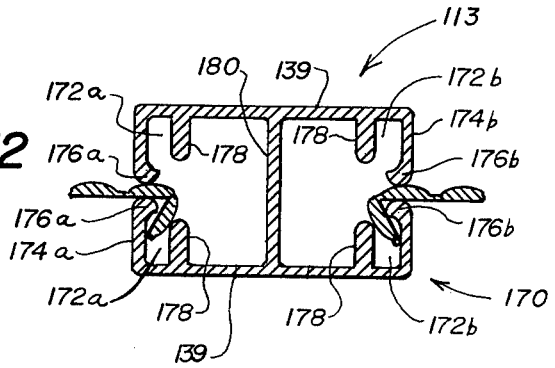
FIG. 12 is an enlarged section taken along the line 12—12 in FIG. 11 showing the cross-section of the vertical center mullion.

Referring now to FIGS. 11 and 12 in which a second embodiment is illustrated, it should be noted that if the distance between the jamb members exceed a predetermined distance established by varying building codes, it is necessary to provide on or more mullions such as the vertical mullion 113. As can best be seen from FIG. 12 the mullion 113 is essentially two jamb members 12, 14 in back to back relationship and will perform in essentially the same manner. Thus, each mullion 113 is an extrusion, indicated generally at 170, the extrusion being of generally rectangular cross-sectional configuration having two spaced apart recesses 172*a*, 172*b*, there being an opening in each of the wall portions 174*a*, 174*b* which face an opposed jamb member, the openings being defined by lip members 176*a* on one side and 176*b* on the other side. Boss means 178 are also provided in the extrusion, the boss means 178 performing in the same manner as the boss means 78 in the embodiment shown in FIG. 3. It should also be noted that the openings defined by the lips 176*a* and 176*b* are of a width substantially less than the width of the recesses 172*a* and 172*b*. A web member 180 extends between the exterior and interior wall portions 139. In order to secure the center mullion to the upper and lower frame members it is necessary to cut or punch out sidewalls 174*a* and 174*b* and the boss means 178 for the extent that the spaced apart wall portions 139 will overlie the upper and lower frame members 16, 18 in the same manner as is done for the left and right jamb members 12 and 14. Similarly, it is also necessary to remove a corresponding portion of the web 180 thus leaving only the spaced apart interior and exterior wall portions 139 overlying the upper and lower frame members. These may be secured in place by pop rivets or the like.

DETAILED DESCRIPTION OF FIGS. 13 AND 14

Figure 13:
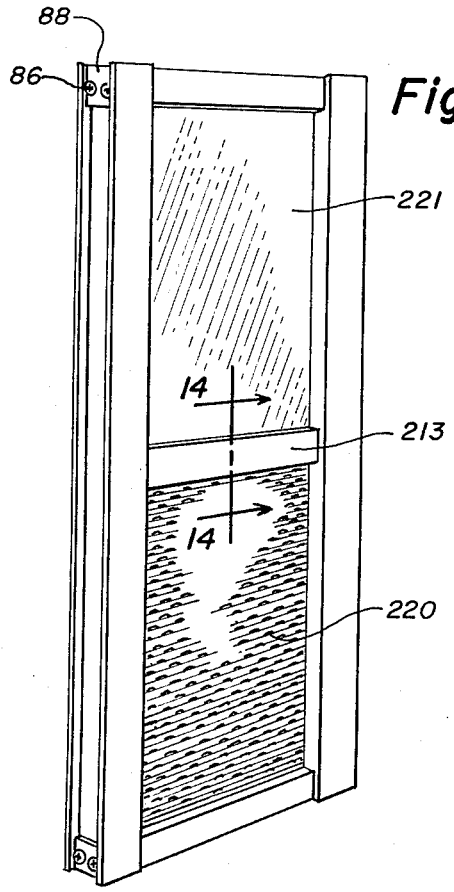
Figure 14:
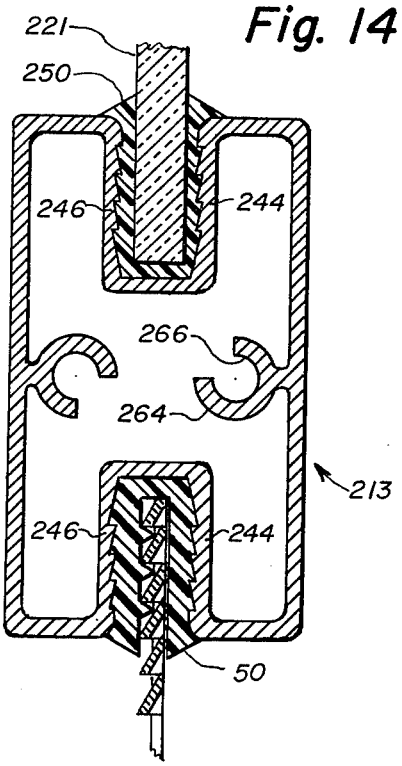
FIG. 14 is an enlarged section taken along the line 14—14 in FIG. 13 showing the cross-section of the transverse mullion.

When utilizing wide shutters of the type shown in FIG. 11 it may be desirable to utilize a horizontal mullion instead of a vertical mullion 113. Similarly, in some situations it may be desirable to provide a shutter assembly having panel parts of differing constructions. Thus, for example, as can be seen in FIG. 13, the lower panel 220 may be of expanded metal and the upper panel 221 may be of a clear material such as double width tempered glass or clear plastic material such as plexiglass. The transversely extending mullion disposed in the center of this type of design is identified at 213 and, as can best be seen from FIG. 14, consists essentially of two upper and lower frame members disposed in immediate back to back relationship. Thus the center mullion 213 is of a generally rectangular cross-sectional configuration and is provided with opposed channels defined by sidewalls 244, 246, each of the sidewalls 244 and 246 being provided with grooves of the same construction as are in the sidewalls 44, 46. In the embodiment shown in FIG. 14 the lowermost channel receives a resilient insert 50 of the same construction as that utilized in the first embodiment shown for example in FIG. 10. This insert will engage the expanded metal material in substantially identically the same manner as does the insert in the upper frame member 16 in FIG. 1. If a smooth transparent material 221 is employed in the upper panel a resilient insert 250 may be provided, this insert having opposed smooth sidewalls which frictionally engage the material 221 to hold it in place. However, if the upper panel also utilizes an expanded metal sheet the upper channel will utilize the insert 50. The transversely extending center mullion is also provided with bosses 264 provided with cylindrical recesses 266 which receive threaded fasteners to hold the side frame or jamb members to the transversely extending center mullion.

Figure 7:
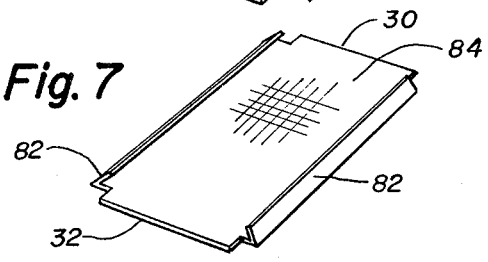
Figure 8:
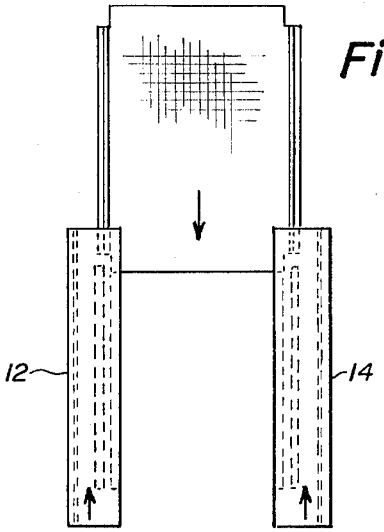

The design shown in FIG. 13 is assembled by bending the expanded metal panel to the configuration shown in FIG. 7. A center portion of each of the jamb members is cut or punched out in addition to the end portions, and then the ends of the transverse mullion are inserted into the center punched out portions and are secured in place by self tapping screws, pop rivets, and/or other fasteners. The upper and lower panels are then inserted into the jambs with the edges of the panel adjacent the transverse mullion being force fit into the associated slot of the center mullion. The upper and lower frame members are then assembled in the manner illustrated in FIG. 9.

While preferred structures in which the principles of the present invention have been incorporated are shown and described above, it is to be understood that the invention is not to be limited to the particular details, shown and described above, but that, in fact, widely differing means may be employed in the practive of the broader aspects of this invention.

What is claimed is:

1. A shutter assembly comprising:

a frame including opposed jamb members each having a generally rectangular cross-sectional configuration and being provided with a recess, an opening in an inner wall in communication with said recess, and boss means extending into said recess, said opening being of a width substantially less than the width of the recess, upper and lower frame members, each member including an inwardly facing slot having opposed sidewalls, at least one of the sidewalls being provided with resilient engaging means, and means interconnecting said opposed jamb members and said upper and lower frame members in such a manner as to form a generally rectangular rigid frame; and expanded metal sheet means mounted within said frame, said expanded metal sheet means being provided with a plurality of outwardly extending air vent defining means, the side edge portions of the expanded metal sheet means being disposed an an angle to the principal portion of the expanded metal sheet means, the distance between the outermost edge of each side edge portion and the adjacent principal portion of the expanded metal sheet means being greater than the width of said opening in the jamb member, said side edge portions being disposed in said recess of the jamb members in such a manner that they are substantially locked therein, and said boss means being so positioned with respect to said opening and said side edge portion that in the event that said side edge portion should bend under loading it will engage said boss means to restrict further bending and thereby maintain said side edge portion within said recess, and the resilient engaging means engaging a plurality of air vent defining means along the upper and lower edges of the expanded metal sheet means in such a manner that the upper and lower edges of the expanded metal sheet means are substantially locked within the upper and lower frame members.

2. The shutter assembly set forth in claim 1 in which said resilient engaging means are resilient teeth extending away from one sidewall towards the other sidewall, said teeth engaging said air vent defining means to firmly hold the upper and lower edges of said expanded metal sheet means within said frame.

3. The shutter assembly set forth in claim 1 in which each air vent defining means includes a convex projection extending away from the original outer surface of the expanded metal sheet means, said projection being disposed above a transversely extending slit in the expanded metal sheet means, the lower edge of the convex projection being in an arcuate shape then viewed from the lower edge of the expanded metal sheet means and the convex projection above the slit tapering towards the original outer surface of the expanded metal sheet means.

4. The shutter assembly set forth in claim 3 in which each of said upper and lower frame members comprises an extrusion including an inwardly facing channel defined by opposed facing sidewalls each of which is provided with a plurality of transversely extending grooves and a resilient insert mounted within said channel and engaging said grooves, said insert including an inwardly facing slot defined by opposed slot defining sidewalls at least one of which is provided with teeth of said resilient material facing towards the other of said slot defining sidewalls, the opposed slot defining sidewalls being spaced away from each other a distance greater than the width of the expanded metal sheet means, and in which the distance from the crest of the teeth to the opposing slot defining sidewall is less than the width of the expanded metal sheet means whereby said teeth will firmly engage said convex projections along the upper and lower edges of the expanded metal sheet means to maintain it within said frame.

5. A shutter assembly comprising in combination a relatively rigid metal sheet provided with a plurality of air vents and a frame about the metal sheet, and in which side edge portions of the metal sheet are disposed at an angle to the principal portion of the metal sheet, the frame including a pair of opposed vertically extending jamb members each having a generally rectangular cross-sectional configuration provided with a recess, an opening in an inner wall in communication with the recess, and boss means extending into the recess, said opening being of a width substantially less than the width of the recess, the distance between the outermost edge of each side portion and the adjacent principal portion of the metal sheet being greater than the width of said opening in the jamb member, said side edge portions being disposed in said recess of the jamb members in such a manner that they are substantially held therein, and said boss means being so positioned with respect to said opening and the side edge portion that in the event that the side edge portion should bend under loading it will engage the boss means to restrict further bending and thereby maintain the side edge portion within the recess, upper and lower horizontally extending frame members each provided with an inwardly facing channel, the channel sidewalls being provided with grooves, resilient vinyl inserts mounted within the channels and engaged by the channel sidewall grooves, the inserts receiving horizontal side edge portions of the metal sheet within a slot defined by opposed insert sidewalls, and means interconnecting the opposed jamb members and the upper and lower frame members to each other in such a manner as to form a generally rectangular frame.

* * * * *